US007621065B2

(12) United States Patent
Gablowski

(10) Patent No.: US 7,621,065 B2
(45) Date of Patent: Nov. 24, 2009

(54) SIGHT DEVICES AND RELATED METHODS

(75) Inventor: Jurgen Gablowski, Oberndorf (DE)

(73) Assignee: Heckler & Koch GmbH, Oberndorf/Neckar (DE)

( * ) Notice: Subject to any disclaimer, the term of this patent is extended or adjusted under 35 U.S.C. 154(b) by 41 days.

(21) Appl. No.: 11/746,353

(22) Filed: May 9, 2007

(65) Prior Publication Data

US 2008/0120892 A1 May 29, 2008

Related U.S. Application Data

(63) Continuation of application No. PCT/EP2005/011524, filed on Oct. 27, 2005.

(30) Foreign Application Priority Data

Nov. 9, 2004 (DE) ..... 10 2004 054 077

(51) Int. Cl.
*F41G 1/00* (2006.01)

(52) U.S. Cl. ..... 42/135; 42/90; 42/111; 42/124; 42/120

(58) Field of Classification Search ..... 42/90, 42/135, 111, 124, 120
See application file for complete search history.

(56) References Cited

U.S. PATENT DOCUMENTS 2,115,184 A * 4/1938 Vaver ..... 42/137
2,445,314 A * 7/1948 Crossman ..... 42/138
2,458,510 A 1/1949 Garand et al.
2,814,118 A * 11/1957 Evans et al. ..... 42/120
4,232,449 A * 11/1980 Linenberger ..... 89/201
4,248,496 A * 2/1981 Akin et al. ..... 356/3
4,691,442 A * 9/1987 Center ..... 42/140
5,408,778 A 4/1995 Goodwin et al.

(Continued)

FOREIGN PATENT DOCUMENTS

FR 2654820 7/2007

OTHER PUBLICATIONS

English translation of the Written Opinion of the International Preliminary Examination Report for international patent application serial No. PCT/EP2005/011524.

(Continued)

*Primary Examiner*—Michael Carone
*Assistant Examiner*—Samir Abdosh
(74) *Attorney, Agent, or Firm*—Hanley, Flight & Zimmerman, LLC

(57) ABSTRACT

Apparatus and methods are described for an example sight device with an adjustable sight line for use in a firearm. The example sight device described herein includes a base plate and a holder, wherein the holder is pivotable and includes a target device that defines the sight line. The sight device also includes a locking device that couples the holder and the base plate in one of a plurality of pivot positions. The locking device includes an adjustable locking element that engages at least one of a plurality of adjustment areas. Further, the plurality of adjustment areas include a plurality of notches, wherein each of the plurality of pivot positions is associated with one of the plurality of adjustment areas based on an ammunition type and one of the plurality of notches based on a distance to a target.

18 Claims, 4 Drawing Sheets

U.S. PATENT DOCUMENTS

| | | | | |
|---|---|---|---|---|
| 6,295,754 | B1 * | 10/2001 | Otteman et al. | 42/124 |
| 6,568,118 | B1 | 5/2003 | Teetzel | |
| 6,637,144 | B2 * | 10/2003 | Nelson et al. | 42/120 |
| 6,931,778 | B1 * | 8/2005 | Nelson et al. | 42/120 |
| 2003/0056417 | A1 * | 3/2003 | Horton | 42/124 |
| 2008/0047190 | A1 * | 2/2008 | May | 42/124 |
| 2009/0071056 | A1 * | 3/2009 | Storch et al. | 42/137 |

OTHER PUBLICATIONS

English translation of the International Search Report for international patent application serial No. PCT/EP2005/011524.

* cited by examiner

SIGHT DEVICES AND RELATED METHODS

RELATED APPLICATIONS

This patent is a continuation of International Patent Application Serial No. PCT/EP2005/011524, filed Oct. 27, 2005, which claims priority to German Patent Application 10 2004 054 077.2, filed on Nov. 9, 2004, both of which are hereby incorporated herein by reference in their entireties.

FIELD OF DISCLOSURE

This disclosure relates generally to firearms, and, more particularly, to sight devices for firearms and related methods.

BACKGROUND

Sight devices are incorporated into firearms to assist a user of the firearm in aiming the firearm toward a specific target. One known sight device is described in U.S. Pat. No. 6,568,118 ("Teezel"). Teezel describes a sighting assembly for a firearm that includes a mounting mechanism for mounting the sighting assembly to the weapon. The sighting assembly described in Teezel features a distance-dependent adjustment with respect to the sightline that may be set to one of a plurality of selectable positions depending on the distance of the desired target.

However, regardless of the distance of the target, there are applications in which different types of ammunition with varying ballistic properties need to be fired from the same gun such as, for example, guns that fire ammunition with different propellants or in which different shot types have specific, differing ballistic properties. There are also guns that are originally designed for two different types of ammunition such as, for example, combinations of conventional guns like assault rifles with grenade launchers. To ensure precise shooting with varying types of ammunition in conventional weapons, several independent sight devices are required for each type of ammunition, and each of these sight devices must be attached to the firearm prior to use with the specific type of ammunition. Further, these sight devices also must have adjustments that may be finely-tuned based on the particular ammunition. Mis-adjustment or the use of the wrong sight device entirely can lead to a poor success rate or complete failure in striking a desired target.

DETAILED DESCRIPTION

The example weapon component described herein relates to a sight device for distance-dependent and ammunition-dependent setting of a sight line. The example sight device includes a holder vertically movable and pivotably coupled with a firearm-safe base plate and serves to incorporate a target device, which defines the sight line. A locking device is provided with an adjustable (i.e., unlockable) locking element that is engageable in a defined adjustment area and, thus, secures the holder and the base plate together in different pivot positions. Each pivot position of the target device defines a distance-dependent angle between the sight line and the bore axis of the firearm so that, depending on the distance of a target, the target is focused upon according to the ballistic curve of the ammunition so that the shot trajectory and the sight line intersect or substantially intersect and the ammunition hits in a desired target area. The target device may be a notch and bead sight arrangement, a front and rear sight arrangement, a sight lens, a laser device or another target device suitable for the particular firearm of interest.

Figure 1:
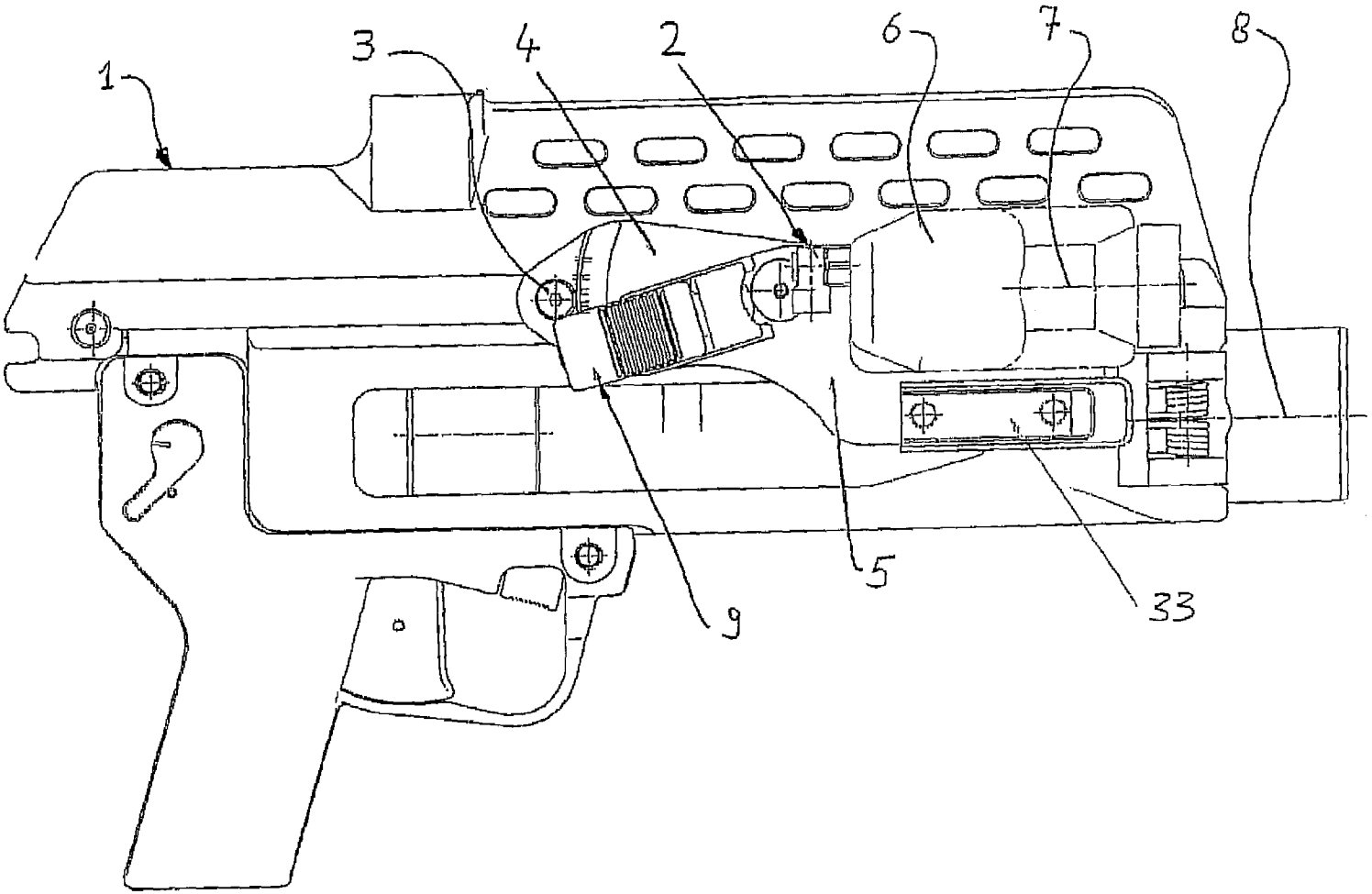
FIG. 1 is a schematic lateral view of an example gun with an example sight device.
Figure 2:
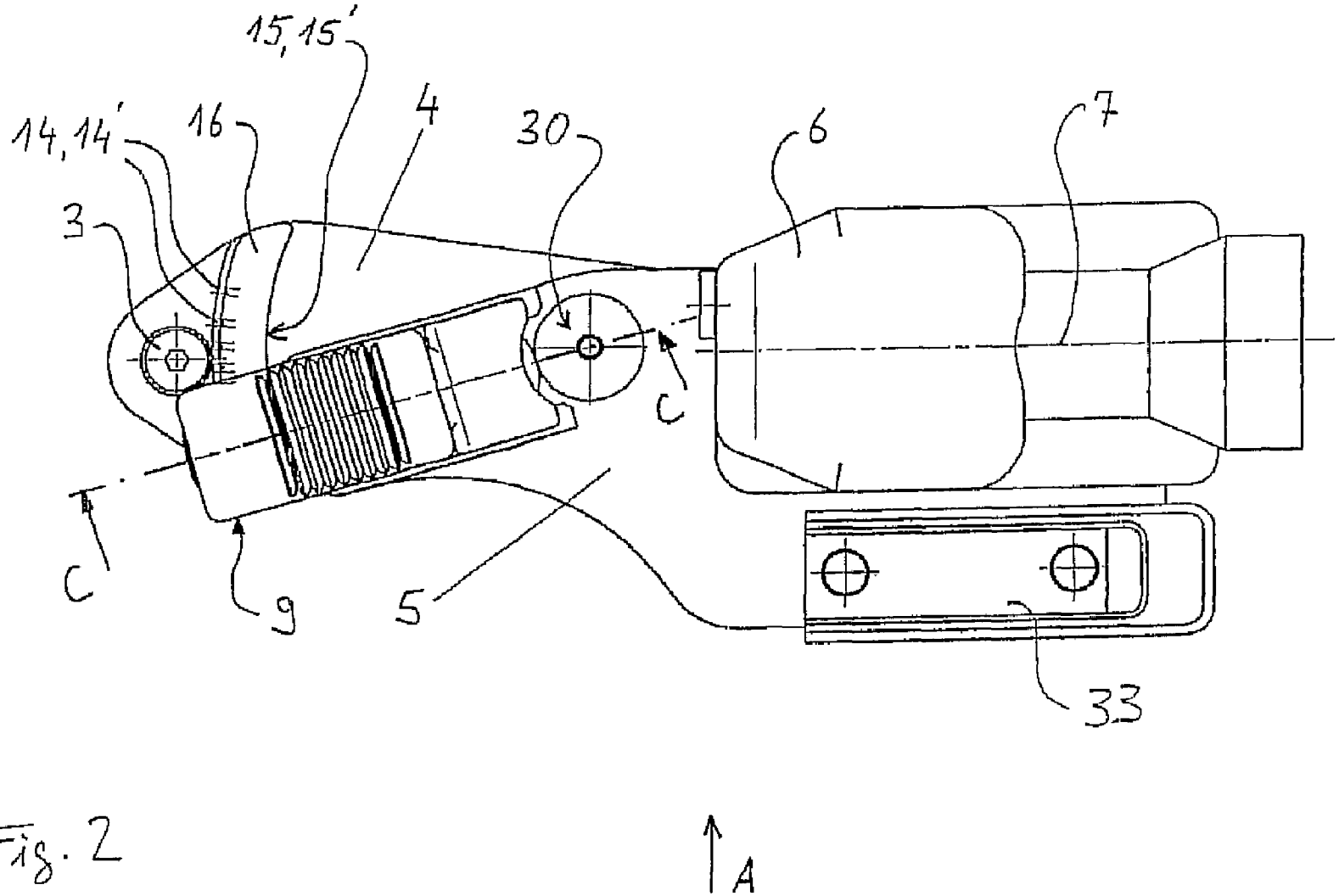
FIG. 2 is schematic lateral view of the example sight device of FIG. 1 without the example gun.
Figure 3:
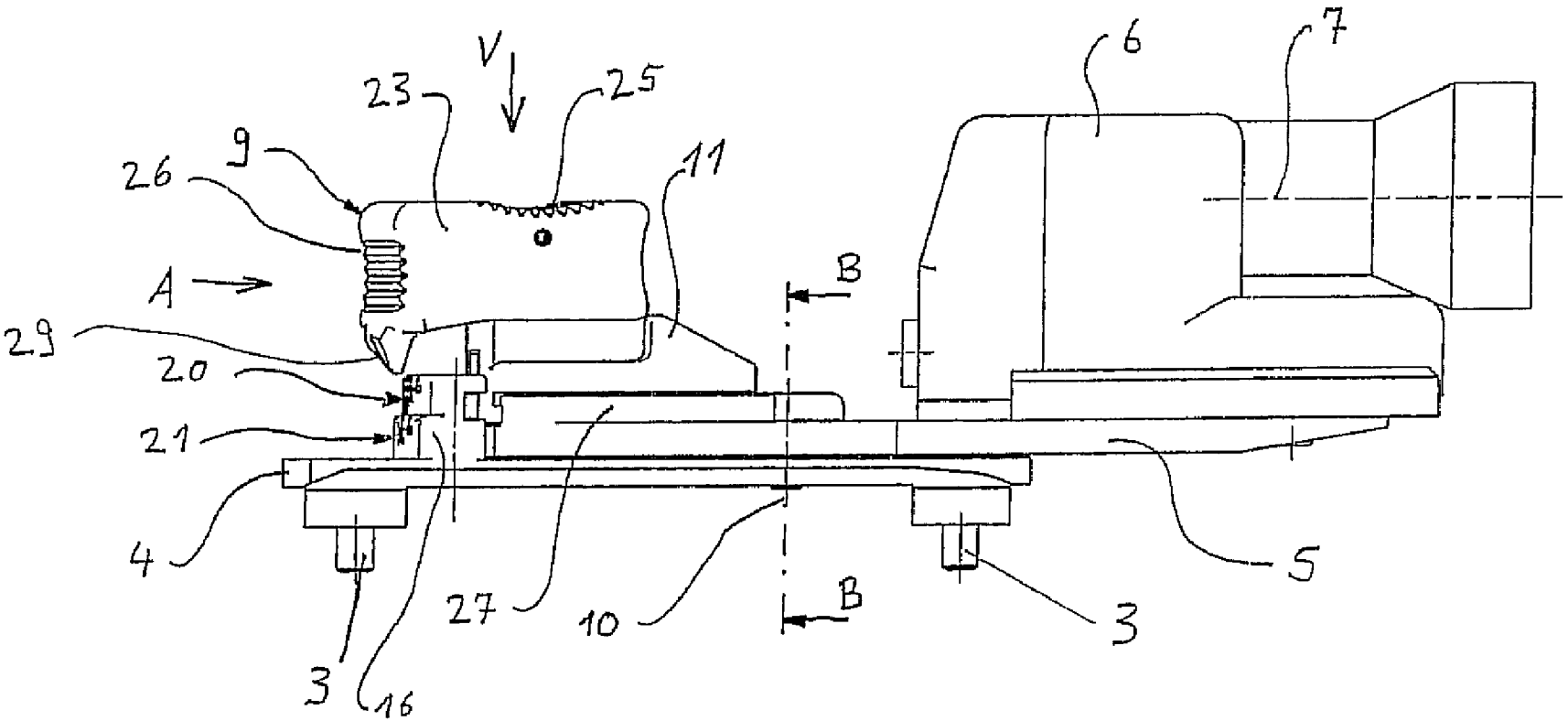
FIG. 3 is a bottom view of the example sight device of FIG. 2, as viewed from the arrow A in FIG. 2).

As shown in FIG. 1, an example firearm 1 includes an example sight device 2 that is coupled to the firearm 1 via fasteners 3 which may be, for example, any mechanical fasteners such as screws. The sight device 2 also includes a base plate 4, which, in the illustrated example, forms the portion of the sight device 2 that is coupled to the firearm 1 via the screws 3. The sight device 2 also includes a holder 5, which carries a target device 6. The target device 6 defines a sight line 7, which may be horizontally pivoted with respect to a bore axis 8 of the firearm 1 via the holder 5. The holder 5 may be locked via a locking device 9 in one or more target-distance-specific pivot positions.

Figure 4:
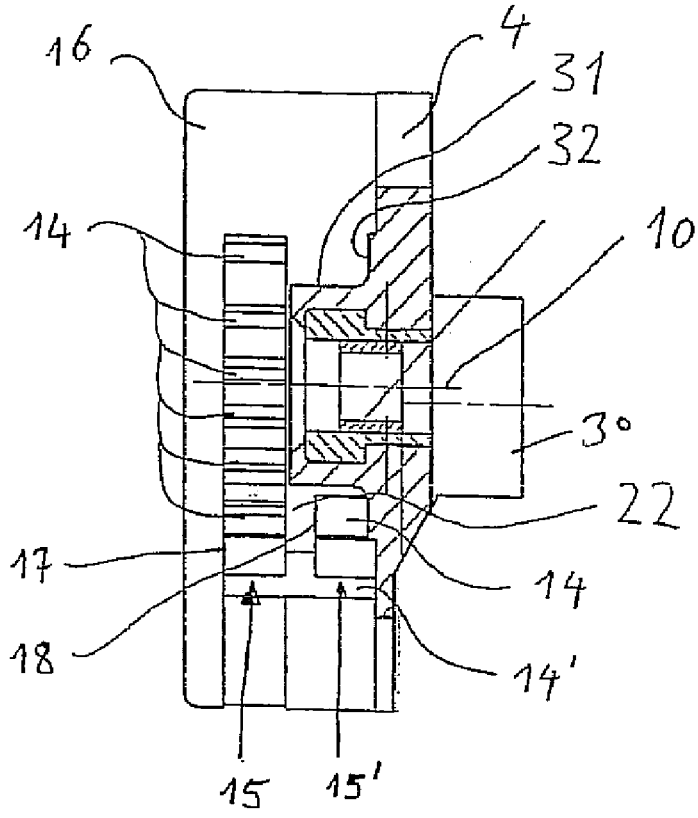
FIG. 4 is a cross sectional view of the example sight device taken along the B-B line of FIG. 3, i.e., through an example base plate.
Figure 5:
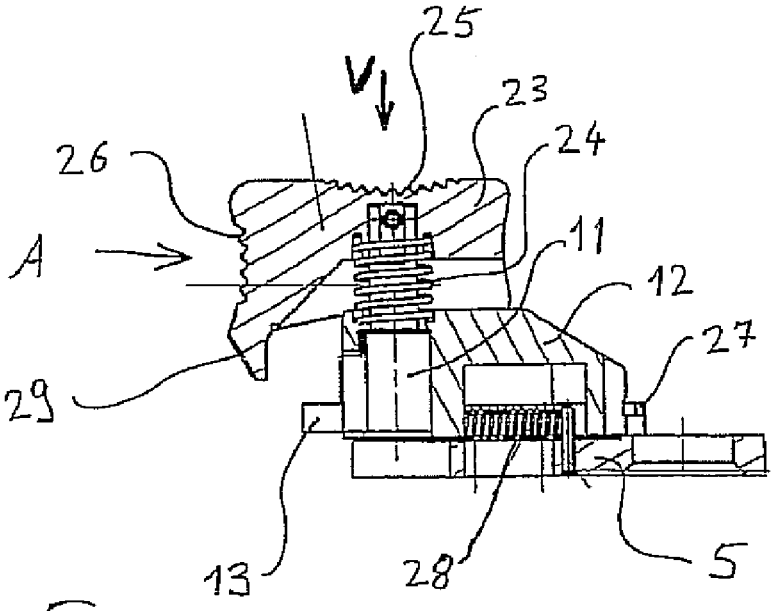
FIG. 5 is a partial cross-sectional view of the sight device through the C-C line of FIG. 2, i.e., through an example locking device.

The structure of the sight device 2 is described in greater detail with reference to FIGS. 2-5. Operative functioning of the locking device 9 is particularly visible in FIG. 3. The holder 5 is coupled to the base plate 4 so that the holder 5 may be pivoted around an axis of rotation 10. The locking device 9 includes a bolt-like locking element 11 (see FIG. 5), which is movably operated in association with a slider 12 in a corresponding recess in a substantially torque-proof manner. FIGS. 4 and 5 show that the locking element 11 includes a nose 13, which engages with corresponding recesses or notches 14 that are circularly arranged around the axis of rotation 10 in two adjustment areas 15, 15'. The adjustment areas 15 and 15' are designed in a positioning rail 16 as grooves 17 and 18, which are designed on the side of the positioning rail 16 that faces the axis of rotation 10. The corresponding notches 14, into which the nose 13 engages in the locked position, are designed in a floor of the grooves 17 and 18. The positioning rail 16 axially protrudes from the base plate 4. Two scales 20 and 21, each of which are associated with one of the adjustment areas 15 and 15' formed by the grooves 17 and 18, are arranged on a peripheral surface of the positioning rail 16 opposite the axis of rotation 10. The scales 20 and 21 include distance designations, wherein each distance designation corresponds with a locking notch 14.

A separating bridge 22, which is broken in the area of a first notch 14' of the plurality of notches 14, is located between the grooves 17 and 18. Here, the nose 13 may be moved via a control element 23, which is attached to the locking element 11 between the grooves 17 and 18. A first pressure spring 24, which pushes the locking element 11 outwards (i.e., upwards in FIG. 5) away from base plate 4, is coupled between the control element 23 and the slider 12. If the nose 13 is located in the area of the first notch 14', the nose 13 is pushed into the area of the groove 17 by the spring force. If the nose 13 is located in the groove 18 in the area of the notch 14, then the nose 13 is held in this groove 18 by the separating bridge 22. The nose 13 is located in the area of the first notch 14' for adjusting the locking element 11 between the groove 17 and the groove 18. The marksman or other operator of the firearm 1 applies an adjustment force V to a first control surface 25, which is arranged on the control element 23. The nose 13 is adjusted in the first notch 14' from the groove 17 into groove 18 when the force of the first pressure spring 24 is overcome. The adjustment area 15 is thereby switched to the adjustment area 15'.

A triggering force A, which pushes the locking element 11 together with the slider 12 in a guide 27 designed on the holder 5 towards the axis of rotation 10, is exerted via a second control surface 26 for releasing the nose 13 from one of the plurality of notches 14 and 14'. A spring force, which is applied via a second pressure spring 28 arranged between the holder 5 and the slider 12, is also thereby overcome. In this unlocked position, the holder 5 may now be pivoted with respect to the base plate 4 around the axis of rotation 10. The nose 13 thereby moves in the groove 17 or the groove 18, depending on into which adjustment area 15 and 15' the nose 13 is fed, and engages into a corresponding one of the plurality of notches 14 and 14' when the control element 23 is released in the desired pivot position. The holder 5 is then fixed in this pivot position through the engagement of the nose 13 in one of the plurality of the notches 14 and 14'.

To control the pivot position and, thus, the set target distance, a pointer 29 is included on the control element 23. The pointer 29 shows or indicates the corresponding distance designation on one of the scales 20 and 21, depending on the setting. These scales 20 and 21 are coupled to a peripheral surface of the positioning rail 16 facing the marksman. One of the scales 20 and 21 is arranged for each of the adjustment areas 15 and 15'. The information for different adjustment areas may be distinguished from each other via a visual indicator such as, for example, color. The control element 23 with the pointer 29 and the arrangement described above show the marksman the pivot position (and, thus, the distance) as well as the selected adjustment area 15 and 15' through the position of the pointer 29 on the corresponding scale 20 or 21.

The sight device 2 includes a pivot bearing 30 (FIGS. 2 and 4), which includes comprises cylindrical and even guide surfaces 31 and 32. The guide surfaces 31 and 32 define the pivot plane of the sight line 7 and ensure that this plane does not change when the sight device 2 is pivoted and in use so that target accuracy is permanently ensured over the entire pivot area.

The locking notches 14 and 14' arranged in the grooves 17 and 18 each correspond with one specific, desired target distance. Further, the distance of separation between consecutive locking notches 14 and 14' is determined according to the ballistic properties of the associated ammunition.

In the illustrated example, the positioning rail 16 and the base plate 4 are designed as one single piece. However there are examples (not shown), in which the positioning rail 16 and other positioning rails may be interchangeably couplable to the base plate 4 in one or more defined positions. In these alternative examples, the positioning rail(s) 16 may be interchanged to prepare the target device 6 for other operating modes such as, for example, for other types of ammunition. In addition, though the illustrated example shows two guide grooves 17 and 18 and set of notches 14 and 14', other examples may include any number of guide grooves with respective notches such as, for example, three, four or more. These additional guide grooves and associated notches may be included on the firearm 1 so that the adjustment areas 15 and 15' (and others not shown) may be mounted on the position rail 16 for more than two different types of ammunition. The corresponding scales 20 and 21 are provided on the opposite side of the grooves 17 and 18. The holder 5 is also provided with an adapter 33, on which control elements (not shown) for the target device 6 may be mounted. The target device 6 itself may be detached from the holder 5 via the use of suitable tools associated with the fasteners 3.

The illustrated example sight device 2 is coupled to the firearm via screws 3, though any known fasteners may be used, as described above. In addition, in other examples (not shown), the sight device 2 and target device 6 may be coupled to the firearm 1 via adapter rails (e.g., Picatinny rails) or other suitable means.

As stated above, the example apparatus described herein is the sight device 2 that is suitable for several types of ammunition that have different ballistic properties. The example sight device 2 allows both exact ammunition-dependent and distance-dependent target detection and capture. Thus, the example sight device 2 described herein includes a plurality of the ammunition-specific adjustment areas 15 and 15', each of which are provided with one or more target-distance-specific locking points or notches 14 and 14'. These locking points or notches 14 and 14' define pivot positions, in which the holder 5 and, thus, the target device 6 may be locked to the base plate 4 and, thus, to the firearm 1 via the lock element 11 and nose 13. The locking points or notches 14 and 14; may be chosen according to the target distance and/or the ballistic properties of the ammunition. Therefore, the sight line 7 also corresponds with the ballistic properties and may be set for target detection and capture for each type of ammunition. The different adjustment areas 15 and 15' and the associated locking points or notches 14 and 14' are, thus, adjusted for a specific type of ammunition, as stated above, and may be used with the sight device 2 without alterations or readjustments and without any other potentially required recalculations.

The locking element 11 may be adjusted selectively between any of the adjustment areas 15 and 15' so that in each adjustment area 15 and 15', only the ammunition-specific and meaningful (i.e., useful) locking points or notches 14 and 14' may be selected. Therefore, the danger of improperly setting the target distance through an intentional or inadvertent fine adjustment or tuning is minimized.

In some examples, to prevent unwanted shifts between the adjustment areas 15 and 15', the selected adjustment area 15 and 15' may only be changed in a first pivot position (e.g., a preferred initial position). Consequently, while in a second locking position (for example all other distance-specific adjustments) changing the adjustment area 15 and 15' is prevented. In addition, the adjustment areas 15 and 15' have a particularly favorable arrangement in that the adjustment areas 15 and 15' are conveniently arranged on the positioning rail 16 (FIGS. 2 and 4) concentrically about the axis of rotation 10.

Further, the positioning rail 16 may be interchangeable with alternative positioning rails if many different types of ammunition are used with one firearm, as described above. For example, each positioning rail may include two adjustment areas, so with three interchangeable positioning rails, a marksman would be able to use up to six different types of ammunition with a single firearm. However, the target device 6, for example, also may be equipped for preferred ammunition combinations (i.e., mission-specific and gun-specific) so that the marksmen would not be overwhelmed with a choice of more than two adjustment areas.

Guiding and securing the sight device 2 with respect to one of the adjustment areas 15 and 15' occurs easily in a user-friendly manner by operation of the nose 13 of the locking element 11, as detailed above. The nose 13 is guided with one hand to a respective one of the adjustment areas 15 and 15' and into a corresponding groove 17 and 18 and notch 14 and 14' in a spring-loaded manner for a robust coupling therein.

Furthermore, as described above, the selection of the correct adjustment area 15 and 15' and the correct distance setting for a specific target, i.e., the correct locking point (groove 17 and 18 and notch 14 and 14') is facilitated by the distance scales 20 and 21 that are attached to the positioning rail 16 and which may be read by the marksman when the firearm is aimed.

Other examples further support the safe and intuitive operation of the example sight device 2. For example, the locking element 11 is movable in two directions: in the direction of the axis of rotation 10 for switching the adjustment area 15 and 15' and also diagonal to the axis of rotation 10 against a spring force to release the nose 13 from the locking notches 14 and 14'. To enable these movements, the locking element 1 itself is arranged in the slider 12 so that the locking element 11 may be moved in one direction (with axis of rotation 10), and the slider 12 is in turn arranged on the holder 5 so that the slider 12 may be moved in another direction (diagonal to the axis of rotation 10). For operation, a handle or control element 23 is provided with the first control surface 25 and the second control surface 26. The first control surface 25 and the second control surface are differently oriented in particular in different vertical planes (see FIGS. 3 and 5) so that functionally clearly separated actuation actions are required to either change the distance in an adjustment area (change between locking notches 14 and 14' in a specific groove 17 or 18) or to determine whether a change should be made to the adjustment area 15 and 15' (adjustment between the guide grooves 17 and 18). In the end, the pointer 29 designed on the handle or control element 23 allows the exact control of the adjustment activity and the quick recording or recognition of the current setting. The pointer 29 marks a specific distance designation in the selected adjustment area 15 and 15' and the marksman can immediately record and/or change the adjustment area 15' and 15 and the set target distance.

Further, in the illustrated example the holder 5 has a plate-like structure, which facilitates coupling of the base plate 4 and the holder 5. This arrangement is advantageous in that this arrangement allows a relatively large, even contact surface, which runs perpendicular to the axis of rotation 10 and prevents deviations of the holder 5 and, thus, of the target device 6 or the sight line 7 from the pivot or sight plane. Moreover, other accessories control elements such as, for example, required switches or controllers may be arranged on the sight device 2 in addition to the actual target device 6. Such additional accessories or components may be coupled to the sight device via the adapter 33, as described above.

Although certain example methods and apparatus have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A sight device with an adjustable sight line for use in a firearm, the sight device comprising:

a base plate;

a holder, wherein the holder is pivotable and includes a target device that defines the sight line;

a locking device that couples the holder and the base plate in one of a plurality of pivot positions;

wherein the locking device includes an adjustable locking element and a plurality of ammunition-specific adjustment areas for a plurality of ammunition types, wherein the adjustable locking element engages at least one of the ammunition-specific adjustment areas out of the plurality of ammunition-specific adjustment areas;

wherein each of the plurality of ammunition-specific adjustment areas includes a plurality of target-distance-specific locking points; and wherein each of the plurality of pivot positions is associated with one of the plurality of ammunition-specific adjustment areas and one of the plurality of target-distance-specific locking points.

2. A sight device as defined in claim 1, wherein the locking element is adjustable between two of the plurality of ammunition-specific adjustment areas.

3. A sight device as defined in claim 1, wherein when the locking element is in a first position, adjustment of the locking element between the ammunition-specific adjustment areas is allowed, and wherein the locking element is in a second position, adjustment of the locking element between the ammunition-specific adjustment areas is prevented by a separation bridge.

4. A sight device as defined in claim 1, wherein the base plate includes a positioning rail and the plurality of ammunition-specific adjustment areas are arranged in the positioning rail concentric to an axis of rotation.

5. A sight device as defined in claim 4, wherein the positioning rail is interchangeable.

6. A sight device as defined in claim 1, wherein the locking element further includes a nose, and wherein the locking element engages at least one of a plurality of ammunition-specific adjustment areas with the nose.

7. A sight device as defined in claim 6, wherein the nose is spring-loaded.

8. A sight device as defined in claim 4, further comprising a distance scale coupled to the positioning rail, wherein the distance scale is readable when the firearm is aimed.

9. A sight device as defined in claim 4, wherein the locking element is coupled to a slider and movable between two of the plurality of ammunition-specific adjustment areas in the direction of the axis of rotation, and wherein the slider is coupled to the holder and movable diagonal to the axis of rotation.

10. A sight device as defined in claim 9, wherein the locking element is coupled to a control element, wherein the control element has a first control surface and a differently oriented second control surface, and wherein the slider is adjusted by a force exerted on one of the first control surface or the second control surface and the locking element is adjusted by a force exerted on the other of the first control surface or the second control surface.

11. A sight device as defined in claim 10, wherein the control element further includes a pointer, wherein the pointer indicates on a scale a distance designation associated with one of the plurality of target-distance-specific locking points of one of the plurality of ammunition-specific adjustment areas.

12. A sight device as defined in claim 1, wherein the holder has a plate-like structure and further includes an adapter, wherein one or more accessories may be coupled to the device.

13. A firearm for shooting ammunition with different ballistic properties, the firearm comprising:

a sight device comprising:

a base plate;

a holder, wherein the holder is pivotable and includes a target device that defines a sight line;

a locking device that couples the holder and the base plate in one of a plurality of pivot positions;

wherein the locking device includes an adjustable locking element and a plurality of ammunition-specific adjustment areas for a plurality of ammunition types, wherein the adjustable locking element engages at least one of the ammunition-specific adjustment areas out of the plurality of ammunition-specific adjustment areas;

wherein each of the plurality of ammunition-specific adjustment areas includes a plurality of target-distance-specific locking points; and wherein each of the plurality of pivot positions is associated with one of the plurality of ammunition-specific adjustment areas and one of the plurality of target-distance-specific locking points.

14. A method of adjusting a firearm to aim at a target based on the distance of the target and the type of ammunition used, the method comprising:

applying a force to one of a first control surface of a control element or a second control surface to the control element;

adjusting a locking device including a locking element and a plurality of ammunition-specific adjustment areas for a plurality of ammunition types, wherein the locking element is adjusted between two of the plurality of ammunition-specific adjustment areas of the locking device;

applying a force to the other of the first control surface of the second control surface;

adjusting the locking element between two of a plurality of target-distance-specific locking points within one of the plurality of ammunition-specific adjustment areas; and releasing the forces so a nose of the locking element engages at least one of the plurality of target-distance-specific locking points in one of the plurality of ammunition-specific adjustment areas.

15. A sight device as defined in claim 4, wherein the plurality of ammunition-specific adjustment areas are laterally displaced.

16. A sight device with an adjustable sight line for use in a firearm, the sight device comprising:

a base plate;

a holder, wherein the holder is pivotable and includes a target device that defines the sight line;

a locking device that couples the holder and the base plate in one of a plurality of pivot positions;

wherein the locking device includes an adjustable locking element that engages at least one of a plurality of ammunition-specific adjustment areas;

wherein each of the plurality of ammunition-specific adjustment areas includes a plurality of target-distance-specific locking points; and wherein each of the plurality of pivot positions is associated with one of the plurality of ammunition-specific adjustment areas and one of the plurality of target-distance-specific locking points; and a pivot bearing including a first guide surface and a second guide surface, wherein the first guide surface and the second guide surface define a sight pivot plane, and wherein the sight pivot plane does not change when the sight is pivoted.

17. A sight device as defined in claim 1, wherein the plurality of target-distance-specific locking points are separated by a plurality of distances determined according to a ballistic property of an ammunition associated with the ammunition-specific adjustment area in which the target-distance-specific locking points are included.

18. A sight device as defined in claim 1, wherein the adjustable locking element may only be moved from one of the plurality of ammunition-specific adjustment areas to a second of the plurality of ammunition-specific adjustment areas when the adjustable locking element is in a pivot position associated with a specific one of the plurality of target-distance-specific locking points.

* * * * *